United States Patent [19]

Csonka et al.

[11] 4,119,068

[45] Oct. 10, 1978

[54] CARBURETOR FOR INTERNAL COMBUSTION ENGINES

[76] Inventors: John J. Csonka, 625 Linwood Ave., Buffalo, N.Y. 14209; Albert B. Csonka, 109 Larchmont Rd., Buffalo, N.Y. 14214

[21] Appl. No.: 675,303

[22] Filed: Apr. 9, 1976

[51] Int. Cl.[2] ..... F02M 7/22

[52] U.S. Cl. ..... 123/117 R; 123/139 AW; 261/44 B; 261/DIG. 56

[58] Field of Search .... 261/44 R, DIG. 39, DIG. 56; 123/117 R, 139 AW

[56] References Cited

U.S. PATENT DOCUMENTS

| | | | |
|---|---|---|---|
| 1,630,410 | 5/1927 | Stevenson | 261/DIG. 39 |
| 1,974,362 | 9/1934 | Weiertz et al. | 261/44 R |
| 2,646,264 | 7/1953 | Morris | 261/44 R |
| 2,742,271 | 4/1956 | McClain | 261/44 R |
| 3,529,809 | 9/1970 | Von Seld | 261/44 R |
| 3,591,148 | 7/1971 | Schmitz | 261/44 R |

*Primary Examiner*—Martin P. Schwadron
*Assistant Examiner*—Richard Gerard
*Attorney, Agent, or Firm*—Christel & Bean

[57] ABSTRACT

A carburetor for internal combustion engines having a housing including a generally discoidal wall and a hub extending axially from the central portion thereof, an air valve having a relatively flat radially extending surface directed toward and concentric with said discoidal wall and with a central conoidal portion having its apex directed toward the interior of said hub portion. The housing wall and the radially extending surface of the valve define an air passage converging radially inwardly to form an annular valving construction and thence diverge into the interior of said hub. The hub includes an annular fuel passage terminating at its upper end in a circumferential series of micro-passages for directing liquid fuel uniformly distributed into said air passage substantially at said valving constriction at right angles to the direction of air flow. The air valve is adjustable axially toward and away from the discoidal wall of the carburetor housing to regulate the volume of air drawn into the engine with which said carburetor is associated.

Fuel is delivered under pressure to the fuel metering valve and from there through said micro-passages and controlled cams simultaneously regulate the axial adjustment of said air valve and the rate of delivery of fuel through said micro-passages according to a predetermined ratio pattern. A third jointly controlled cam simultaneously regulates the ignition timing in accordance with various air and fuel supply settings. The air valve, fuel supply and ignition timing settings are all independent of the existing degree of engine vacuum.

4 Claims, 4 Drawing Figures

CARBURETOR FOR INTERNAL COMBUSTION ENGINES

The Government of the United States of America has rights in this invention pursuant to contract No. EC-77-C-02-4325 awarded by the U.S. Energy Research and Development Administration.

BACKGROUND OF THE INVENTION

This invention relates to improved carburetors for internal combustion engines.

Vast amounts of research and development have gone into the problems incident to providing the most efficient and economical fuel-air mixtures for internal combustion engines but despite this the fuel-air mixtures produced by modern carburetors leave much to be desired as to providing the most efficient and effective fuel-air mixture. Modern carburetors have a main jet and often one or more auxiliary jets for supplying the liquid fuel to the air stream which is drawn into the cylinders of the engine. By its nature the fuel stream issuing from conventional carburetor jets is not evenly distributed throughout the cross section of the intake throat of the carburetor and even relatively high air velocities through the carburetor throat do not sufficiently atomize the liquid fuel in the air stream and do not distribute the same uniformly across a cross section of the carburetor throat.

Present carburetor designs do not produce sufficiently fine droplets of liquid fuel and larger fuel drops tend to precipitate at the cylinder walls and in any event are not evenly mixed in the incoming air stream. The precipitated large fuel drops at the cylinder walls are not ignited and cause hydro-carbon pollution.

In present carburetors there is a faster air flow along the center line of the venturi tube where the main fuel nozzle is disposed than at the marginal portions of the tube which is one significant factor resulting in uneven fuel distribution in the incoming air stream.

Many expedients have been proposed to attain better mixture as by producing turbulence at the inlet ports of the engine and in the valve housings and even in the engine cylinders but the benefits of these expedients have been less than adequate to provide optimum fuel-air mixture and distribution.

SUMMARY OF THE INVENTION

According to the present invention in its broadest aspect a radially disposed annular air passage is formed in a pressurized carburetor. This passage has its entry at the outer periphery thereof and converges inwardly to a zone of maximum constriction then widens and changes from a radial direction to an axial direction whereby the fuel-air mixture passes in down-draft flow to the intake manifold of the internal combustion engine which the carburetor serves.

Liquid fuel is projected into the radial air stream at right angles to the direction of air flow, that is, in an axial direction with respect to the axis of the carburetor. This is provided by means of a circumferential series of axially extending micro-grooves or micro-channels formed in the members which form the lower wall of the radial air passage and are spaced uniformly about a circle which is coincident with the maximum constriction of the air passage.

One of the two members which form the radial air passage is axially adjustable to vary the width of the constricted portion of the air passage and this adjustment is effected by movement of the conventional accelerator pedal of the vehicle with which the engine is associated. The flow of liquid fuel to the aforesaid micro-grooves is likewise adjusted by movements of the accelerator and the present invention provides a definite relationship between air and fuel feed at all positions of the accelerator. The fuel is metered generally proportionally to the amount of air consumed by the engine, with an always high, almost constant air-to-fuel ratio. This arrangement always assures the highest acceptable air-to-fuel ratio and thus results in the lowest fuel consumption. Means are also provided for regulating the ignition timing for various accelerator positions and this adjustment likewise bears a definite predetermined relationship with respect to the air and fuel adjustments established by the accelerator pedal.

DESCRIPTION OF THE ILLUSTRATED EMBODIMENT

Figure 1:
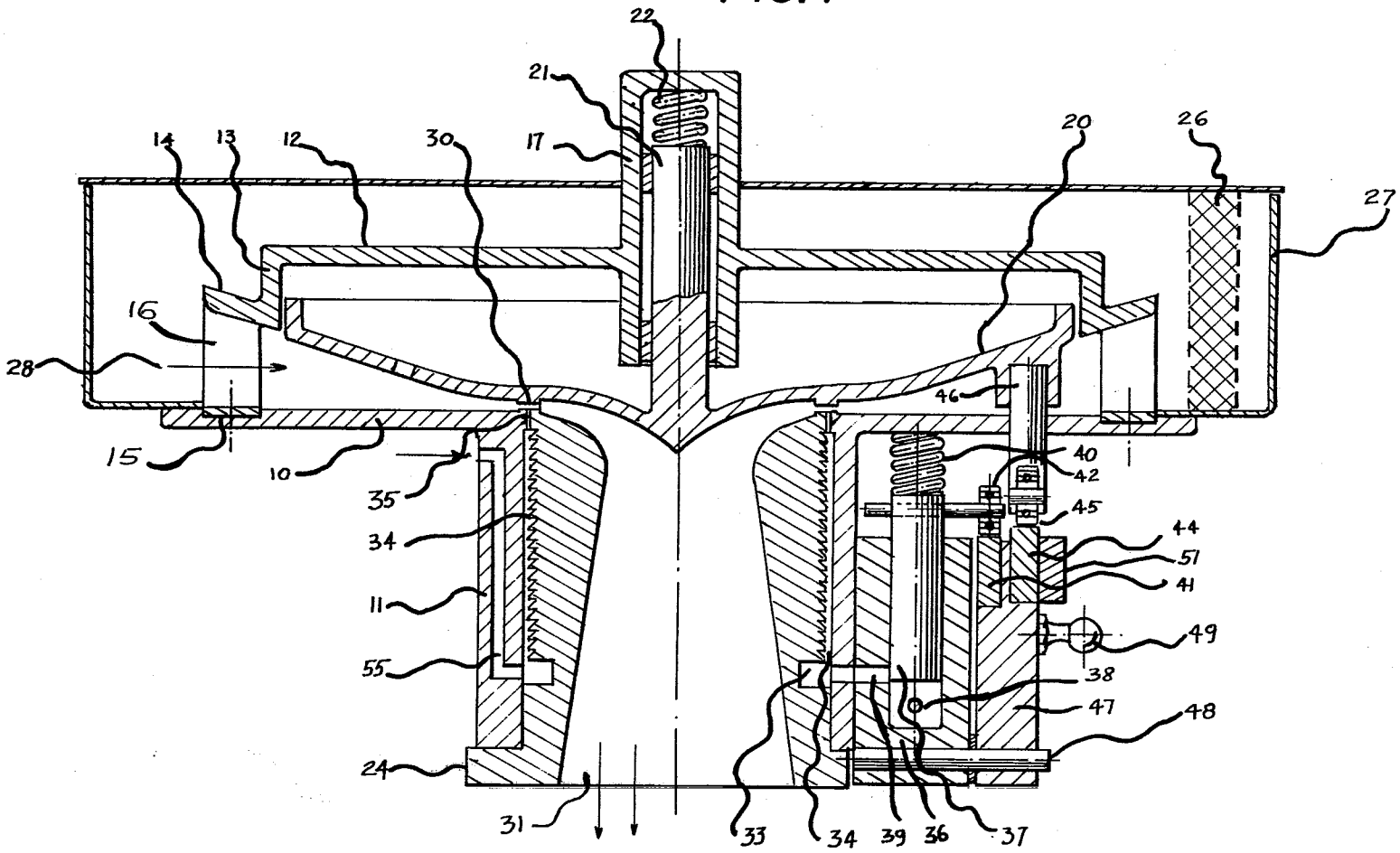
FIG. 1 is a vertical axial cross sectional view through one form of the carburetor of the present invention.
Figure 3:
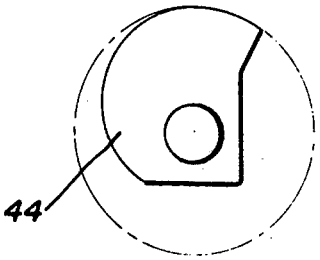
FIG. 3 is a side elevational view of the air control valve cam.
Figure 4:
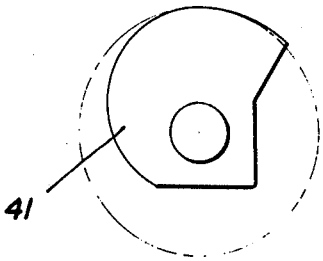
FIG. 4 is a side elevational view of the fuel control valve cam.
Figure 2:
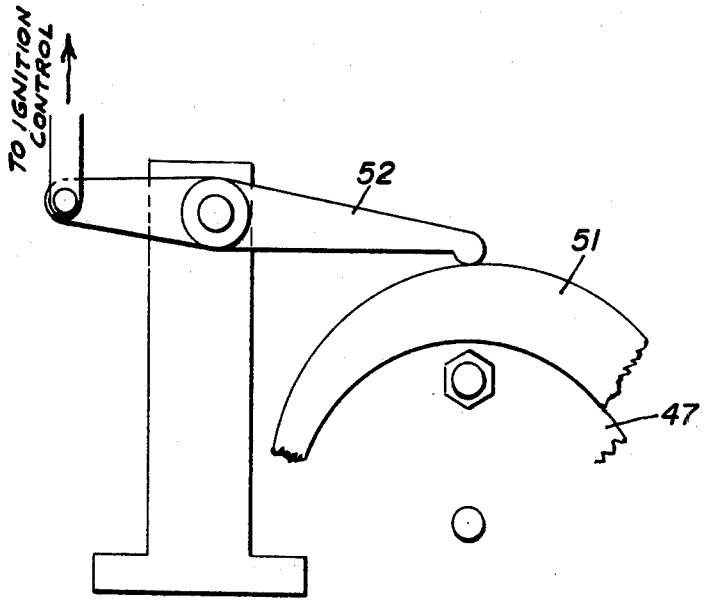
FIG. 2 is a fragmentary side elevational view of the ignition control cam.

In the drawing a lower housing member of the carburetor illustrated therein comprises an annular discoidal portion 10 and an integral coaxial hub portion 11. A coaxial annular cover member 12 which is generally discoidal and has an axially extending annular cylindrical portion 13 and a generally radial marginal flange 14. A lower ring member 15 is integral with marginal flange 14 and is held in axial spaced relation with respect to flange 14 by vertical web formations 16. Ring member 15 is secured to the discoidal portion 10 of the housing member and thus portion 10 and flange 14 form an annular radial passage for entry of air to the carburetor. Cover member 12 includes a central hub formation 17.

An annular generally discoidal air valve 20 includes a shaft 21 which is journaled in hub 17 to permit free axial movement of valve 20 toward and away from the discoidal portion 10 of the carburetor housing. A coil spring 22 between the upper end of shaft 21 and the upper wall of hub 17 urges valve 20 downwardly as viewed in the drawing. A flanged sleeve 24 fits within the hub portion 11 of the carburetor housing.

A generally radially disposed air intake passage is formed by flange 14 of cover member 12, the underside of valve 20, the discoidal portion 10 of the carburetor housing, and the upper portion of flanged sleeve 24. Air is drawn into the intake passage, through a conventional annular air filter element 26 which is disposed in a filter housing 27, by the suction of the engine with which the carburetor is associated. It will be noted that the air enters the intake passage at 28 in direct radial flow through the filter without change of direction.

It will be noted that the effective cross-sectional area of air flow converges from the inlet 28 to the point where the valve 20 most closely approaches the housing and at this point the surface of valve 20 has an annular radially extending valve seat 30. The effective area of flow of this portion of the air passage may be varied by moving valve 20 axially toward and away from the adjacent portion of the housing and this of course varies the volume of air to the engine. Beyond the valve seat the passage again widens and, due to the interior configuration of sleeve 24 and the lower central portion of valve 20, the incoming air is directed axially downwardly and passes to the engine intake manifold as at 31.

It will be understood that the velocity of the incoming air will be greatest at the most constricted part of the intake passage, that is, at valve seat 30. Efficient air flow is attained by reason of the fact that the air flows radially inward to and beyond valve seat 30 with no change of direction. As will presently be seen, fuel is introduced directly at valve seat 30 in a direction perpendicular to the direction of air flow.

It will be noted that sleeve 24 has an external circular groove 33 and is reduced in diameter above groove 33 to form an annular fuel passage 34 which terminates in a circumferential series of fine axially extending grooves or micropasages 35 formed in the sleeve 24 or in the interior of hub 11 or in both.

A block 36 is fixed to hub 11 and receives a cylindrical fuel metering valve 37 which, by vertical sliding movement, controls pressurized liquid fuel flow from an intake port 38 to a passage 39 which discharges into groove 33 from which the fuel is uniformly distributed to all micro-passages.

The fuel enters through passage 39 into distributing groove 33, from where it flows, under atmospheric pressure, upward in axial direction into the high velocity air flow at valve seat 30 without substantially changing its direction. The high vacuum existing in the area of the air valve seat and the impact of the high velocity air flow result in a practically perfect atomization of the fuel and in a totally uniform mixing of the fuel with air. The velocity of the incoming air will be greatest at the most constricted part of the intake passage, that is, at valve seat 30. Fuel is introduced directly against valve seat 30 in a direction perpendicular to the direction of air flow. Valve 37 is biased downwardly by a spring 40 and is adjustable upwardly by a cam 41 which acts against a follower roller 42 carried by valve 37.

A second cam 44 acts against a follower 45 carried by a vertical pin 46 which is fixed to valve 20, the pin 46 being slidable in the discoidal portion 10 of the housing. Thus valve 20 is moved upwardly by pin 46 against the bias of spring 22 to adjust the air intake. The cams 41, 44 and 51 are carried by an arm 47 which is pivoted to block 36 as at 48. Pivotal movement of arm 47 is controlled by a ball joint connection 49 which is connected with the conventional accelerator pedal of the vehicle. The third cam 51 on rock arm 47 acts against a follower (not shown) which controls the ignition timing. By the foregoing cam means the air intake, the liquid fuel feed, and the ignition timing are all adjusted so that their relationship gives optimum performance and economy at various accelerator pedal positions. The profile of the fuel controlling cam continues to increase the rate of fuel feed beyond the point where the metered amount of air has reached its maximum.

An air feed duct 55 in hub 11 provides for air being introduced with the liquid fuel in groove 33 and promotes atomization of the fuel by forming a foamy mixture therewith. This introduction of air also insures that the suction effect of the carburetor throat does not affect flow of liquid fuel past the fuel metering valve 36.

The exterior reduced diameter portion of sleeve 24 or inner wall of hub 11 between groove 33 and the micro-grooves 35 is provided with a series of annular saw-tooth shaped grooves which are provided only to trap solid impurities in the fuel which have passed through the conventional fuel filter.

The preferred embodiment of the present invention has been described herein and shown in the accompanying drawing to illustrate the underlying principles of the invention but it is to be understood that numerous modifications may be made without departing from the broad spirit and scope of the invention.

We claim:

1. A carburetor having a housing including a generally discoidal wall and a hub portion extending axially from the central portion thereof, an air valve having a relatively flat surface directed toward and concentric with said discoidal wall and having a central conoidal portion having its apex of said surface directed toward the interior of said hub portion, said housing wall and said valve surface defining an air passage converging radially inwardly to form an annular valving constriction and thence widening into the interior of said hub portion, said hub portion having an annular cylindrical fuel passage terminating at its upper end in a circumferential series of axially extending micro-passages for directing liquid fuel into said air passage substantially at right angles to the direction of air flow at said valving constriction whereby the fuel is atomized by the air flow at said constriction, means for selectively adjusting said air valve toward and away from said discoidal wall to regulate the volume of air drawn into an engine with which said carburetor is associated, means for supplying predetermined measured amounts of pressurized fuel to said cylindrical fuel passage and valve means for regulating said supply, said air valve adjusting means and said pressurized fuel regulating means having a common control means whereby the ratio of air to fuel is predetermined and variable at various positions of said control means, and ignition timing adjustment means connected with said common control means whereby the ignition timing has a predetermined setting for each position of said air valve and fuel valve.

2. A carburetor according to claim 1 wherein said annular fuel passage includes a cylindrical wall having a series of annular saw tooth grooves therein for trapping solid impurities in said fuel.

3. A carburetor according to claim 1 having a fuel valve controlling cam the profile of which is such that the rate of fuel feed continues to increase beyond the point where the metered amount of air has reached its maximum.

4. A carburetor according to claim 1 including means for supplying liquid fuel under constant predetermined pressure to the fuel passage regulating valve means and from there to said annular fuel passage, from where it is forced by atmospheric pressure into the constriction in the valve seat zone of the radial intake passage.

* * * * *